US006465750B1

(12) United States Patent
Rubenstein

(10) Patent No.: US 6,465,750 B1
(45) Date of Patent: Oct. 15, 2002

(54) COVER FOR NONFUNCTIONAL BUTTONS

(75) Inventor: Brandon Rubenstein, Loveland, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/918,033

(22) Filed: Jul. 29, 2001

(51) Int. Cl.[7] ..... H01H 9/20
(52) U.S. Cl. ..... 200/43.21; 200/333
(58) Field of Search ..... 200/43.01, 13.16, 200/43.18, 43.19, 43.21, 43.22, 333

(56) References Cited

U.S. PATENT DOCUMENTS 3,917,921 A * 11/1975 Jakubauskas ..... 200/333
5,193,924 A * 3/1993 Larson ..... 400/472
5,348,405 A * 9/1994 Lupkas ..... 200/43.19

* cited by examiner

*Primary Examiner*—Michael Friedhofer

(57) ABSTRACT

A channel cover is used to protect nonfunctional buttons until such time as the nonfunctional buttons are made functional in consequence of a system upgrade. The channel cover includes a bight, a first leg and a second leg. The first leg has a lip for mating engagement with female structure on at least one of the buttons.

9 Claims, 3 Drawing Sheets

COVER FOR NONFUNCTIONAL BUTTONS

BACKGROUND OF THE INVENTION

1. Field of the Invention

The invention pertains to the field of housings for electrical switches, such as button switches. More specifically, the housings hide and protect the buttons.

2. Discussion of the Related Art

New electronic systems devices, such as telecommunications servers, network servers, personal computers, and the like, derive from the efforts of planning and design teams. These teams are tasked with responsibilities that include adding new capabilities into existing systems, as well as building new products. Design and production schedules may be developed according to a strict timetable in an effort to get new products to market as soon as possible. It is frequently the case that new developments in electronic systems are rapidly overtaken and surpassed in an innovative marketplace.

As new products are being developed, future system enhancements may be planned for development and release that is scheduled to occur after the initial product release. Thereafter, the system may be sold with the enhancements intact, or a base model may be sold with an upgrade pathway for inclusion of the enhancements. The enhancements typically include hardware and related software.

An upgrade pathway may include, for example, adding additional busses or sockets for incorporating modular cards. The system housings may also, for example, be provided with switches or buttons that are needed for operator interaction according to planned improvements.

An array of nonfunctional buttons may be added to establish the upgrade pathway. These buttons are susceptible to damage or they may become fouled with debris before their use is actually required. It is desirable to provide a cover that protects such buttons, however, the cover must also permit free use of the buttons once the upgrade occurs. In order to avoid operator confusion as to the purpose of these nonfunctional buttons, it is also desirable that the cover hides the buttons from view until such time as an upgrade renders the buttons functional.

SUMMARY OF THE INVENTION

A button cover according to the principles described herein overcomes the problems described above and advances the art by providing a channel cover that prevents damage to the buttons, protects the buttons from debris, and/or hides the buttons from view until such time as the buttons are needed.

The channel cover according to the instrumentalities described herein comprises a central bight connected to a first leg and a second leg to define a recess therebetween. The first leg comprises a wall of transverse orientation with respect to the bight, and a lip protruding from the wall into the recess. The channel cover has sufficient flexion to permit expansion of the recess to accommodate the button when the lip passes over the button as the button is inserted into the recess. The channel cover may be used to cover a single button or, in an elongated configuration, it is capable of covering a plurality of the buttons when they are arranged in a row. The wall of the first leg preferably has sufficient length to prevent depression of the button when the channel cover is installed in the mating engagement over the button.

In especially preferred embodiments, the channel cover includes a nib protruding into the recess opposite the lip, and this nib engages complimentary structure on the button to secure the channel cover in place.

In still other embodiments, the lip comprises an upper face extending in parallel with the bight. The upper face may be formed of a raised rim that is set off a distance from the wall of the first leg.

The transverse orientation of the wall of the first leg does not have to be a right angle orientation and may, for example, comprise an oblique angle orientation between respective planar surfaces of the wall and the bight.

The aforementioned channel cover may be used according to a method comprising the steps of placing the lip into the complimentary female groove with the second leg resting atop the button, and pressing down on the channel cover to flex the channel cover as the channel cover expands to accommodate the button into the recess. The channel cover may thereafter be detached from the button by pulling straight up on the channel cover.

For example, a button or contact switch may be placed proximate a PCI bus to control delivery of electrical current to the bus. The button could be depressed if an operator desires either to insert or remove a card from the bus, in order that the task may be accomplished without having to power down the entire device.

DETAILED DESCRIPTION OF THE PREFERRED EMBODIMENTS

There will now be shown by way of example and not by way of limitation, a channel cover according to the instrumentalities described herein comprising a central bight connected to a first leg and a second leg to define a recess therebetween. The first leg comprises a wall of transverse orientation with respect to the bight, and a lip protruding from the wall into the recess. The channel cover has sufficient flexion to permit expansion of the recess to accommodate the button when the lip passes over the button as the button is inserted into the recess. The channel cover may be used to cover a single button or, in an elongated configuration, it is capable of covering a plurality of the buttons when the plurality of buttons are arranged in a row. The wall of the first leg preferably has sufficient length to prevent depression of the button when the channel cover is installed in the mating engagement over the button.

Figure 1:
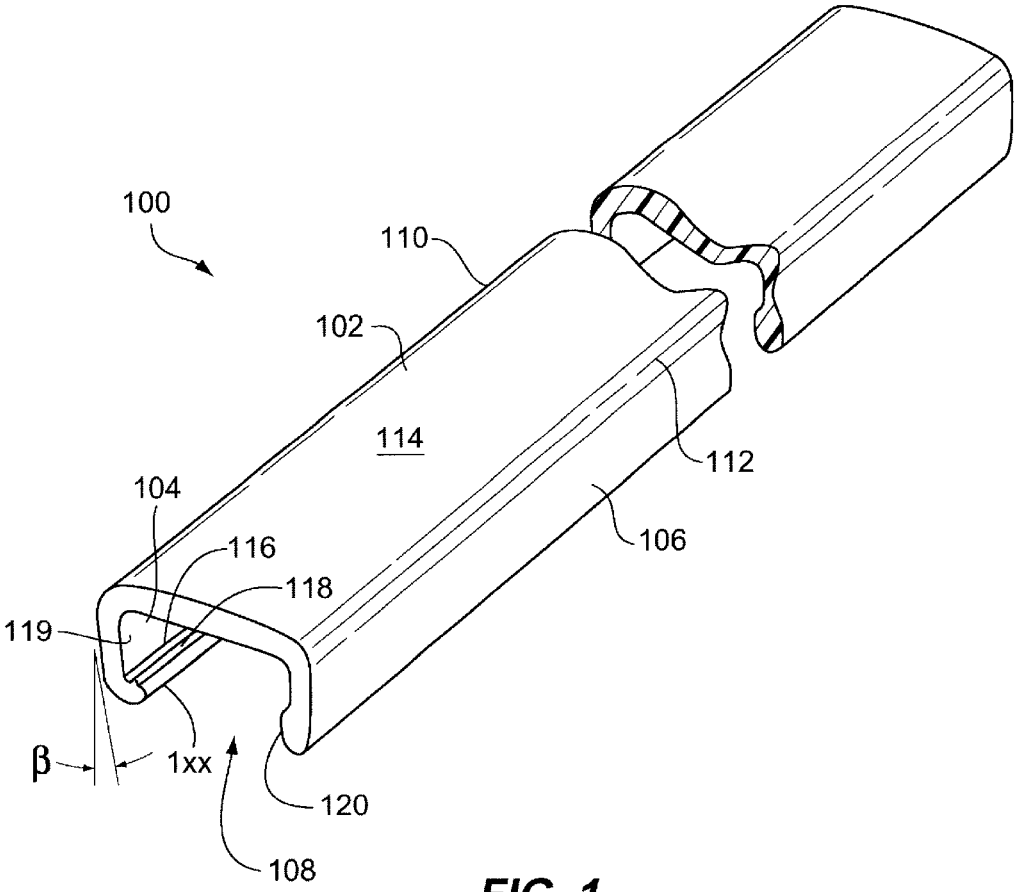
FIG. 1 is a top, right front perspective view of a channel cover for use in protecting nonfunctional buttons.

FIG. 1 depicts a channel-shaped button cover 100, i.e., a channel-cover, for use in covering nonfunctional buttons. The channel cover 100 is integrally formed in three main segments including a central bight 102 that preferably but optionally has an arcuate shape, a first leg 104, and a second leg 106. These segments 102, 104, and 106 combine to form a channel-shaped recess 108. Channel cover 100 may be formed in any length including a length that is sufficient to cover a single button or a row of buttons.

The first and second legs 104, 106 have a generally transverse orientation with respect to bight 102, such that they intersect with bight 102 along edges 110 and 112, but are generally perpendicular to wall 114 of bight 102. This transverse orientation is only generally perpendicular in the sense that central wall 114 preferably but optionally forms an arched structure that may cause first leg 104 and/or second leg 106 to deviate inwardly from the perpendicular or true vertical by an angle β, which may, for example, range from 0° to 30 but is preferably less than 15° and most preferably about 5°.

The lower extremity of first leg 104 contains a lip 115 protruding into the recess 108. Lip 115 preferably but optionally extends for the entire length of channel cover 100, or lip 115 may only be formed in the precise location where it is useful for engaging complimentary structure on the buttons over which channel cover 100 will be placed in the intended environment of use. Lip 115 includes an upper face 116 that includes an upwardly pointing rim 118, which is set off inwardly a distance from the inner face 119 of first leg 104.

The lower margin of second leg 106 contains a semi-ovaloid nib 120 that protrudes into recess 108 opposite lip 115.

Channel cover 100 is preferably made of a flexible material, such as a synthetic resin, that permits flexure of the first leg 104 over the range of angle β. This material is also preferably but optionally opaque and serves to hide the buttons that it covers.

Figure 2:
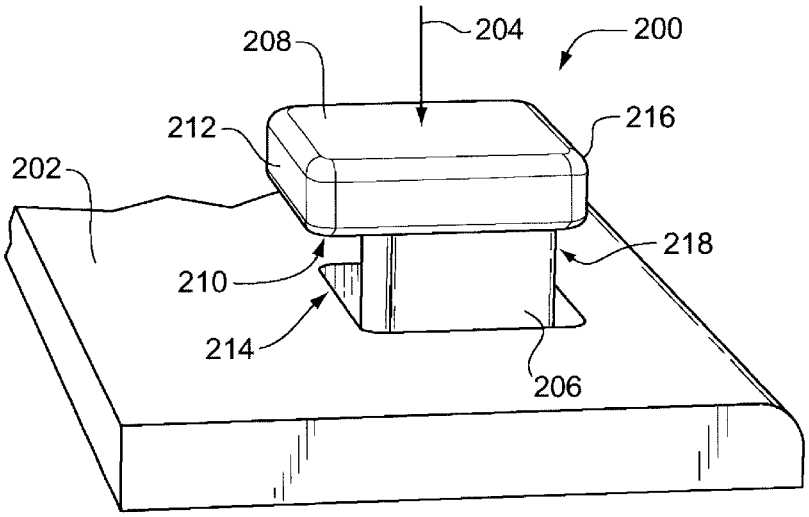
FIG. 2 is a top, right side perspective view of a button having features for complimentary engagement with the channel cover shown in FIG. 1.

FIG. 2 depicts a single button 200 that is mounted in a button housing 202. Interior to the button housing and not shown in FIG. 2, are a conventional spring biasing button 200 into the position shown in FIG. 2, as well as a conventional electrical contact mechanism that makes electrical contact when button 200 is depressed against the spring bias in the direction of arrow 204.

Button 200 comprises a neck 206 and a top plate 208. The top plate 208 presents a greater surface area than does the top midsection of neck 206. Top plate 208 includes a forward-facing chin 210 with a rounded face 212. Chin 210 overhangs the button housing 202 to provide a forward-side recess or female groove 214 beneath the chin 210. The forward-side recess 214 has sufficient dimensions for loose fitting male-female mating engagement with the lip 115 shown in FIG. 1. Top plate 208 also includes a rearward overhang 216, which provides a rearward recess 218 for complimentary engagement with the nib 120 on the second leg 106 of channel cover 100 shown in FIG. 1.

Figure 3:
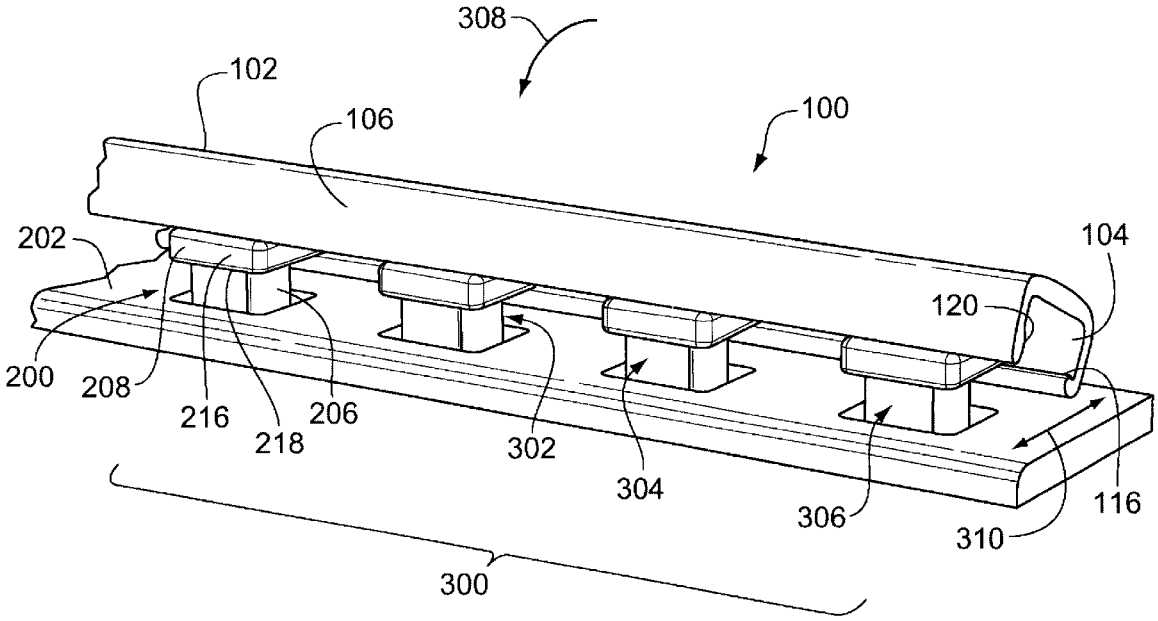
FIG. 3 is a perspective view of the channel cover during installation over a row of buttons.

FIG. 3 depicts the channel cover 100 during insertion over a row 300 of buttons 200, 302, 304, and 306. The buttons 302, 304, and 306 are identical to button 200. Lip 115 has been inserted into the recesses 214 beneath the chins 210 (not shown in FIG. 3), with nib 120 of the second leg 106 resting beneath overhang 216 of the respective buttons. Downward force exerted in the direction of arrow 308 causes outward expansion of the first and second legs 104 and 106 in the directions of arrow 310 as the nib 120 rides over the respective overhangs 216 and snaps into place.

Figure 4:
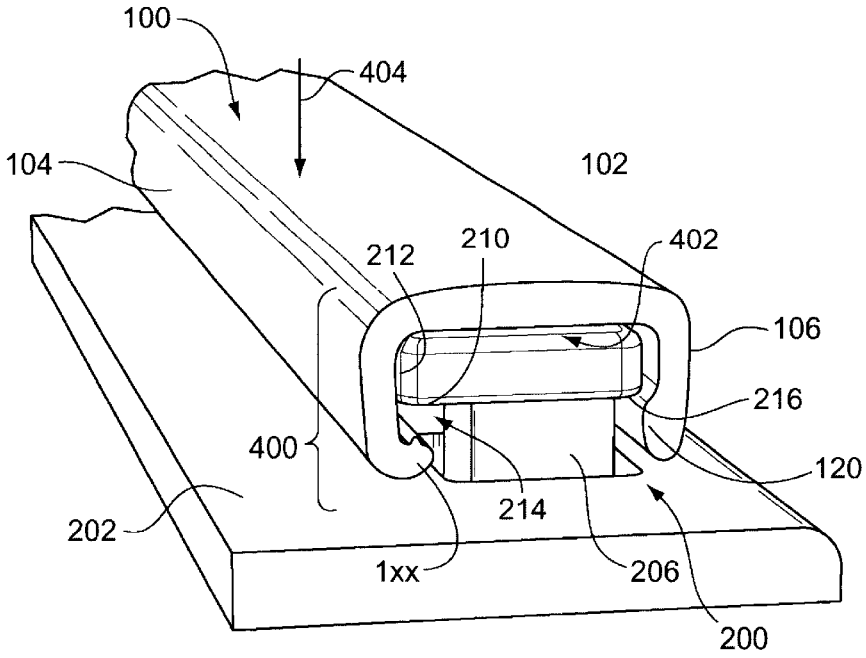
FIG. 4 is a top, left side perspective view of the channel cover after installation of the channel cover is complete.

FIG. 4 depicts the channel cover 100 fully attached after the insertion procedure shown in FIG. 3. Nib 120 resides in rearward recess 216 beneath overhang 216, and the lip 115 resides in the forward recess 214 beneath chin 210. Lip 115 and nib 120 abut the button housing 202 and have sufficient vertical rise 400 to create a small gap 402 and prevent depression of button 200 in consequence of downward pressure 404 that may be applied to channel cover 100.

Figure 5:
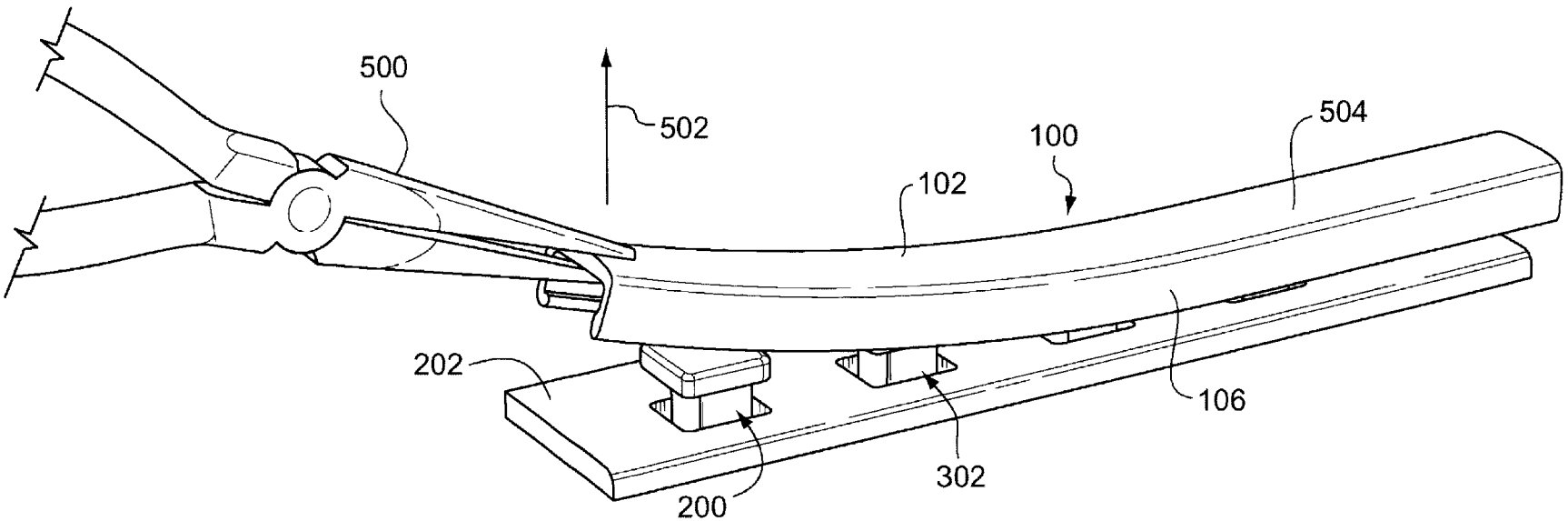
FIG. 5 depicts removal of the channel cover from its place of installation to reveal the buttons underneath.

FIG. 5 depicts the removal of channel cover 100 at such time as buttons, such as buttons 200 and 302 may be made function in consequence of a system upgrade. A pair of needle-nose pliers is used to grasp channel cover 100 on bight 102. Upward lifting motion of the pliers 500 in the direction of arrow 502 causes outward flexion of the channel cover that permits removal. A snapping noise is heard as the channel cover is removed from each button. The channel cover may be cut, e.g., at position 504, so that a portion of channel cover may remain in place over buttons that have not yet been made functional.

The foregoing discussion is intended to illustrate the concepts of the invention by way of example with emphasis upon the preferred embodiments and instrumentalities. Accordingly, the disclosed embodiments and instrumentalities are not exhaustive of all options or mannerisms for practicing the disclosed principles of the invention. The inventor hereby states his intention to rely upon the Doctrine of Equivalents in protecting the full scope and spirit of the invention.

I claim:

1. A channel cover assembly, comprising:

a button comprising a head plate and a neck, the head plate presenting a greater surface area than does the neck to provide a first female receptacle on one side of the neck beneath the top plate and a second female receptacle on another side of the neck opposite the first female receptacle beneath the head plate;

a channel cover for use in covering the button, comprising a central bight connected to a first leg and a second leg to define a channel-shaped recess therebetween, the first leg comprising a first wall of transverse orientation with respect to the central bight and a lip protruding from the first wall into the channel-shaped recess, the second leg comprising a second wall of transverse orientation with respect to the bight and a nib protruding from the second wall into the channel-shaped recess opposite the lip, the channel cover having sufficient flexion to permit expansion of the channel-shaped recess to accommodate the button when the lip passes over the button as the button is inserted into the channel-shaped recess to achieve mating engagement of the lip into the first female receptacle and of the nib into the second female receptacle.

2. The channel cover assembly of claim 1, wherein the lip of the first leg comprises an upper face extending in parallel with the bight, the upper face having a raised rim that is set off a distance from the wall of the first leg.

3. The channel cover assembly of claim 1, wherein the transverse orientation of the wall of the first leg comprises an oblique angle orientation between respective planar surfaces of the wall and the bight.

4. The channel cover assembly of claim 1 formed to cover a plurality of the buttons when the buttons are arranged in a row.

5. The channel cover assembly of claim 1, wherein the wall of the first leg has sufficient reach to prevent depression of the button when the channel cover is installed in mating engagement over the button.

6. A method of installing a channel cover over a button, where the channel cover includes a central bight connected to a first leg and a second leg to define a channel-shaped recess therebetween, the first leg comprising a wall of transverse orientation with respect to the bight and a lip protruding from the wall into the recess, the channel having sufficient flexion to permit expansion of the recess to accommodate the button when the lip passes over the button as the button is inserted into the recess, and the button includes a complimentary female receptacle for mating engagement with the lip, the method comprising the steps of:

placing the lip into the complimentary female groove with the second leg resting atop the button; and pressing on the channel cover to flex the channel cover as the channel cover expands to accommodate the button into the recess with the lip engaging the female receptacle.

7. The method according to claim 6, further including a step of pulling straight up on the channel cover to remove the channel cover from the button.

8. The method according to claim 6, wherein the button is a member of a plurality of buttons in a row of buttons, and the step of pressing comprises accommodating the plurality of buttons into the recess.

9. A channel cover for placement over a button, comprising:

a central bight connected to a first leg and a second leg to define a recess therebetween, the first leg comprising a wall of transverse orientation with respect to the bight and a lip protruding from the wall into the recess, the channel cover having sufficient flexion to permit expansion of the recess to accommodate the button when the lip passes over the button as the lip is inserted into the recess, wherein the lip comprises an upper face extending in parallel with the bight, the upper face having a raised rim that is set off a distance from the wall of the first leg.

* * * * *